US005411181A

United States Patent [19]

Knickerbocker

[11] Patent Number: 5,411,181

[45] Date of Patent: May 2, 1995

[54] VARIABLE RESTRICTOR FOR A MANUALLY ACTUATED PUMP

[76] Inventor: Michael G. Knickerbocker, 4516 Hillside Ct., Crystal Lake, Ill. 60012

[21] Appl. No.: 128,768

[22] Filed: Sep. 17, 1993

[51] Int. Cl.[6] ..... B65D 88/54

[52] U.S. Cl. ..... 222/309; 222/321.8

[58] Field of Search ..... 222/309, 321, 383, 385; 92/13

[56] References Cited

U.S. PATENT DOCUMENTS

| | | | |
|---|---|---|---|
| 1,362,077 | 12/1920 | Bobrick et al. | 222/321 X |
| 2,530,909 | 11/1950 | Riggs . | |
| 2,534,504 | 12/1950 | Engstrom | 222/309 |
| 3,191,807 | 6/1965 | Rodrigues, Jr. . | |
| 3,216,624 | 11/1965 | Corsette | 222/309 X |
| 3,343,539 | 9/1967 | Moorhouse . | |
| 3,754,687 | 8/1973 | Norton . | |
| 3,759,425 | 9/1973 | Lee . | |
| 3,827,605 | 8/1974 | Knickerbocker . | |
| 3,827,606 | 8/1974 | Knickerbocker . | |
| 4,081,111 | 3/1978 | Sandow | 222/309 |
| 4,185,755 | 1/1980 | Sachs et al. | 222/309 X |
| 4,433,799 | 2/1984 | Corsette | 222/309 |
| 4,454,964 | 6/1984 | Sacher | 222/309 X |
| 4,871,092 | 10/1989 | Maerte | 222/309 X |
| 4,986,453 | 1/1991 | Lina et al. | 222/321 |

FOREIGN PATENT DOCUMENTS

| | | | |
|---|---|---|---|
| 2658486 | 8/1991 | France | 222/309 |

*Primary Examiner*—Gregory L. Huson
*Attorney, Agent, or Firm*—Frijouf, Rust & Pyle

[57] ABSTRACT

An apparatus is disclosed for a variable restrictor for a manually actuated pump for dispensing a liquid within a container comprising a body having an internal cylinder secured to the container. A piston is slidably disposed within the internal cylinder of the body having a stem end extending external to the body. The stem end supports an actuator having a terminal orifice communicating with an internal stem passage of the pump stem for discharging the liquid from the container through the terminal orifice upon movement of the actuator from an extended position to a retracted position. The variable restrictor is provided for varying said retracted position to reduce the longitudinal movement of the actuator from the extended position to the retracted position for reducing the volume of liquid discharged from the terminal orifice.

16 Claims, 5 Drawing Sheets

VARIABLE RESTRICTOR FOR A MANUALLY ACTUATED PUMP

BACKGROUND OF THE INVENTION

1. Field of the Invention

This invention relates to dispensing systems and more particularly to a variable restrictor for a manually actuated pump for dispensing a liquid from a container. More particularly, this invention relates to a variable restrictor for a manually actuated pump having an actuator movable between an extended position and a retracted position with an adjustable restrictor for varying the output of the manually actuated pump.

2. Background of the Invention

Dispensing systems such as hand operated pumps have been used to dispense a wide variety of products such as household, institutional and personal care products and the like. A hand operated pump comprises a body defining an internal pump cylinder for receiving a reciprocating piston slidably disposed within the internal pump cylinder. The pump is secured to a container for receiving liquid from the container through an induction tube. A pump stem extends from the body in conjunction with a piston having a spring biasing the piston and the stem into an extended position. An actuator having a terminal orifice is secured to the pump stem for enabling a operator to reciprocate the piston within the body. A plurality of one-way valves are disposed within the combination of the piston, stem and body for enabling the liquid to be collected and dispensed through the terminal orifice upon movement of the actuator from the extended position to a retracted position.

In some circumstances, it is desirable to change the volume of liquid discharged from a dispenser when the actuator is moved from the extended position to a retracted position. Various means have been devised in the prior art for changing the volume output of devices unrelated to hand operated pumps.

U.S. Pat. No. 2,530,909 to Riggs relates to a pipette which is adapted for use by milk inspectors during the period of testing for bacteria which may be present in the milk.

U.S. Pat. No. 3,191,807 to Rodrigues, Jr. relates to the dispensing of liquids in equal volumes, and more particularly to the dispensing of equal amounts of liquid in the ultra-micro range.

U.S. Pat. No. 3,343,539 to Moorhouse relates to a syringe comprising a reservoir, a piston and adjusting means for predetermining a quantity of material to be drawn and discharged from the reservoir with each stroke of the piston.

U.S. Pat. No. 3,754,687 to Norton relates to a pipetting dispenser of the piston-cylinder type with adjustable stop means to limit travel of the piston within predetermined limits for insuring the repeated dispensing of like volumes of liquid from said pipette in successive operations of the dispenser for any adjusted position of the stop means.

U.S. Pat. No. 3,759,425 to Lee relates to a syringe gun suitable for dispensing liquid for discharging the contents of a barrel therefrom, an inlet valve enabling the passage of liquid or semi-liquid into the barrel, and a discharge valve enabling the passage of liquid or semi-liquid out of the barrel. At least one of said valves is the combination of a chamber, an inlet orifice to the chamber, a plate within the chamber of substantially greater cross-sectional area than that of the inlet orifice, the plate having an inlet side and an outlet side, a passage for liquid or semi-liquid from the inlet side of the plate to the outlet side of the plate, and an outlet orifice for enabling the passage of liquid or semi-liquid from the chamber. In this valve arrangement the plate seals the inlet orifice under pressure upon the outlet side of the plate and, in the alternative, permits the passage of liquid or semi-liquid through the inlet orifice, by the flexing or moving of the plate away from the inlet orifice and through said passage to the outlet orifice by flexing of the resilient plate or the moving of a floating plate from the inlet orifice, and through said passage to the outlet orifice.

Others in the prior art have incorporated means for locking a hand operated pump in an inoperative position. U.S. Pat. No. 3,827,605 to Knickerbocker relates to a liquid dispensing pump having a pump plunger guided for axial operative movement through a container closure member. A locking collar was mounted for rotary movement to deflect adjacent locking tongues into the path of operative movement of the plunger for immobilize the plunger.

U.S. Pat. No. 3,827,606 to Knickerbocker relates to a liquid dispensing pump having a pump plunger guided for axial operative movement through a container closure cap with a rotary control member mounted on the closure cap. Locking fingers project upwardly from the closure cap having radially deflectable shaft portions which may be deflected into locking relation with the pump plunger to immobilize the pump plunger.

Although the aforementioned prior references have contributed to the dispensing art, there is a need in the art for an improved manually actuated pump for dispensing a liquid from a container which provides a variable output from the pump.

Therefore, it is an object of this invention to provide a variable restrictor for a manually actuated pump for dispensing a liquid from a container that is easy to vary the volume output of a hand operated pump.

Another object of this invention is to provide a variable restrictor for a manually actuated pump for dispensing a liquid from a container wherein the variable output manually operated pump is simple to operate by the operator.

Another object of this invention is to provide a variable restrictor for a manually actuated pump for dispensing a liquid from a container that does-not appreciably increase material cost of the manually operated pump.

Another object of this invention is to provide a variable restrictor for a manually actuated pump for dispensing a liquid from a container that is easy to manufacture.

Another object of this invention is to provide a variable restrictor for a manually actuated pump for dispensing a liquid from a container that does not appreciably increase the overall manufacturing cost of the pump.

Another object of this invention is to provide a variable restrictor for a manually actuated pump for dispensing a liquid from a container wherein the actuator remains aligned during actuation by an operator.

Another object of this invention is to provide a variable restrictor for a manually actuated pump for dispensing a liquid from a container wherein the pump may be varied with a minimal adjustment by the operator.

Another object of this invention is to provide a variable restrictor for a manually actuated pump for dispensing a liquid from a container incorporating a variable restrictor that is external to the body to inhibit contamination from product residue and the like.

The foregoing has outlined some of the more pertinent objects of the present invention. These objects should be construed as merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a variable restrictor for a manually actuated pump for dispensing a variable volume of liquid from a container comprising a body having a first and a second body end with an internal pump cylinder interposed therebetween. The body is secured to the container with an induction tube affixed to the second body end of the body for providing fluid communication between the liquid within the container and the internal pump cylinder of the body. A first one-way valve means enables the flow of the liquid only from the container into the internal pump cylinder of the body. A piston is slidably disposed within the internal pump cylinder of the body. A pump stem has a first and a second stem end with an internal stem passage extending therein. The first stem end is disposed external from the body with the second stem end being disposed within the internal pump cylinder of the body. A spring biases the pump stem and the piston into an extended position. A second one-way valve means comprises the second stem end cooperating with the piston for enabling the flow of the liquid only from the internal pump cylinder into the internal stem passage of the pump stem. An actuator has a terminal orifice communicating with the internal stem passage of the pump stem. The actuator discharges a volume of the liquid from the container through the terminal orifice upon the longitudinal movement of the actuator from an extended position to a retracted position by an operator. The invention includes the variable restrictor for varying the retracted position to vary the longitudinal movement of the actuator from the extended position to the retracted position for altering the volume of liquid discharged from the container through the terminal orifice.

In a more specific embodiment of the invention, the container has a rim defining the container opening with an adjacent securing means. The securing means comprises a flange extending radially outwardly from the body. A closure having a central opening for receiving the body therein enables the closure to be affixed to the container and securing the flange into engagement with the closure rim.

The overhang defines the retracted position upon engagement of the base surface of the actuator with said overhang for varying the longitudinal movement of the actuator from the extended position to the retracted position. The variable restrictor comprises an inner collar having an overhang extending radially inwardly toward the pump stem. The variable restrictor is rotatable about an axis extending through the pump stem for varying the position of the overhang for varying the longitudinal movement of the actuator from the extended position to the retracted position determine the volume of liquid discharged from the container through the terminal orifice upon longitudinal movement of the actuator from the extended position to the retracted position.

Preferably, the variable restrictor comprises an inner collar and an outer collar with the inner collar disposed coaxially within the outer collar. Thread means are interposed between the inner collar and the outer collar for enabling rotation of the inner collar within the outer collar. The rotation of the inner collar within the outer collar varies the position of the overhang for varying the retracted position for varying the longitudinal distance from the extended position to the retracted position to vary the volume of liquid discharged from the container through the terminal orifice upon movement of the actuator from the extended position to the retracted position.

In one embodiment of the invention, a flange extends radially outwardly from the body for enabling a closure to secure the flange into engagement with the container rim. The outer collar is secured relative to the flange with thread means being interposed between the inner collar and the outer collar. The thread means comprises a helical thread recess defined in one of the collars for receiving a helical thread projection extending from the other of the collars. A control collar may be secured to the inner collar for preventing extreme inward rotation of the inner collar.

The foregoing has outlined rather broadly the more pertinent and important features of the present invention in order that the detailed description that follows may be better understood and the present contribution to the art can be fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
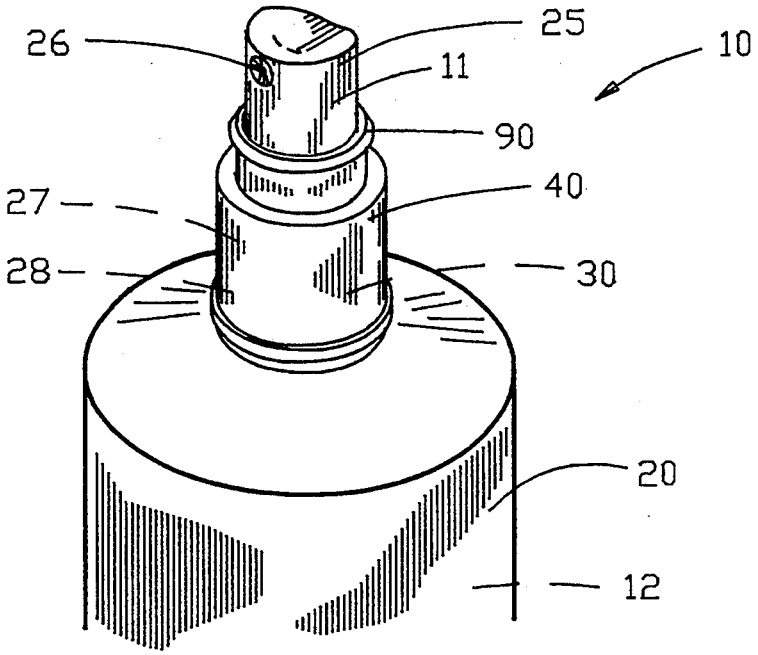
FIG. 1 is a partial isometric view of the improved variable restrictor for a manually actuated pump of the present invention secured to a container with an actuator located in an extended position.
Figure 2:
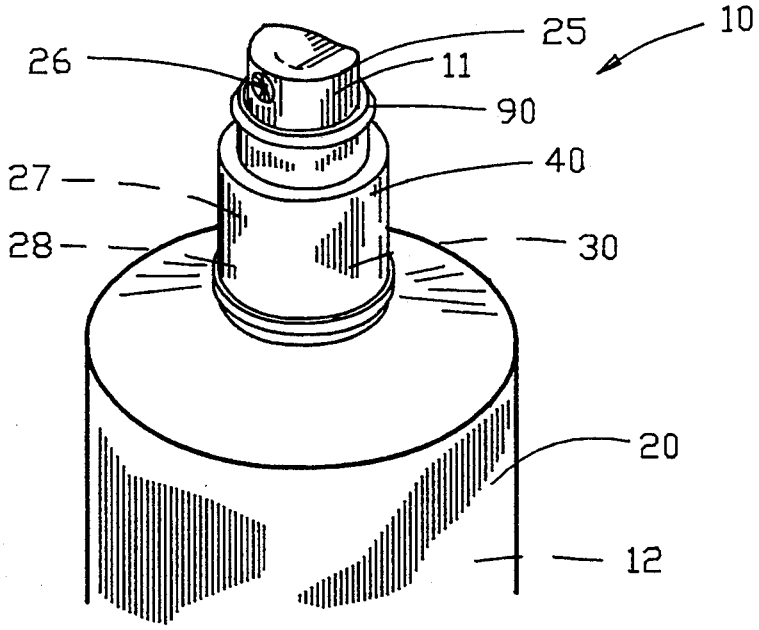
FIG. 2 is a partial isometric view of the improved variable restrictor for a manually actuated pump of FIG. 1 with the actuator located in a first retracted position thereby dispensing a first volume of a liquid from the container.

FIGS. 1 and 2 are a partial isometric views of the improved variable restrictor 10 for a manually actuated pump 11 of the present invention for pumping a liquid 12 from a container 20 upon depression of an actuator 25. As will be described in greater detail hereinafter, reciprocation of the actuator 25 between the extended position shown in FIG. 1 and the retracted position shown in FIG. 2 results in the pumping of the liquid 12 in the container 20 through a terminal orifice 26. The container 20 is shown as a conventional container comprising a container rim 27 defining a container opening 28 therein.

Figure 4:
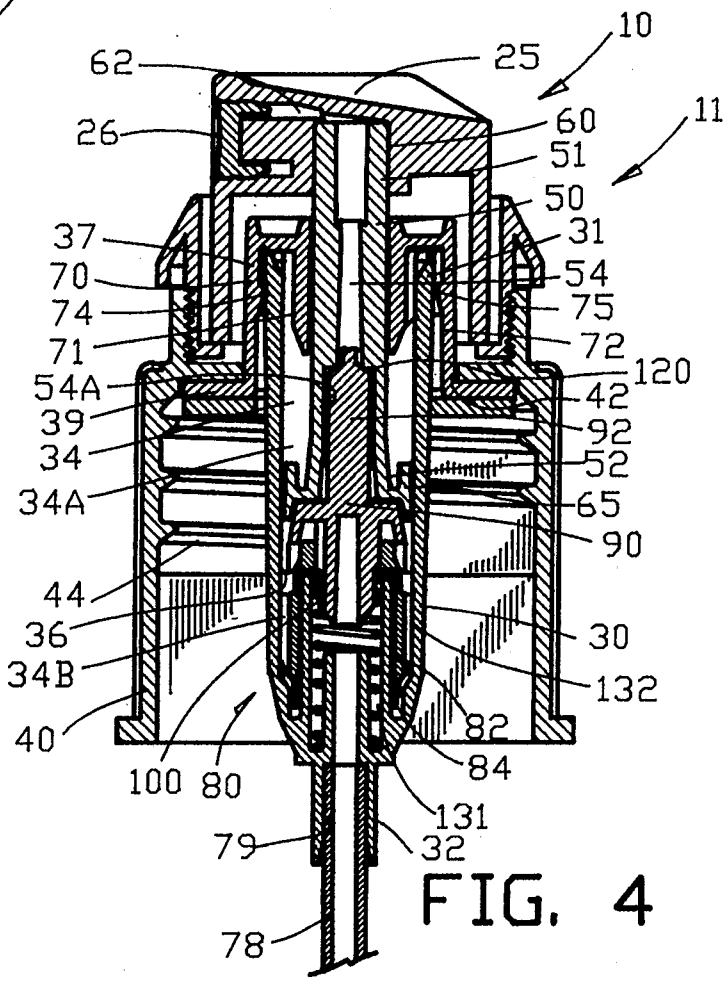
FIG. 4 is a side sectional view of the improved variable restrictor for a manually actuated pump of FIG. 2 with the actuator located in the first retracted position.
Figure 3:
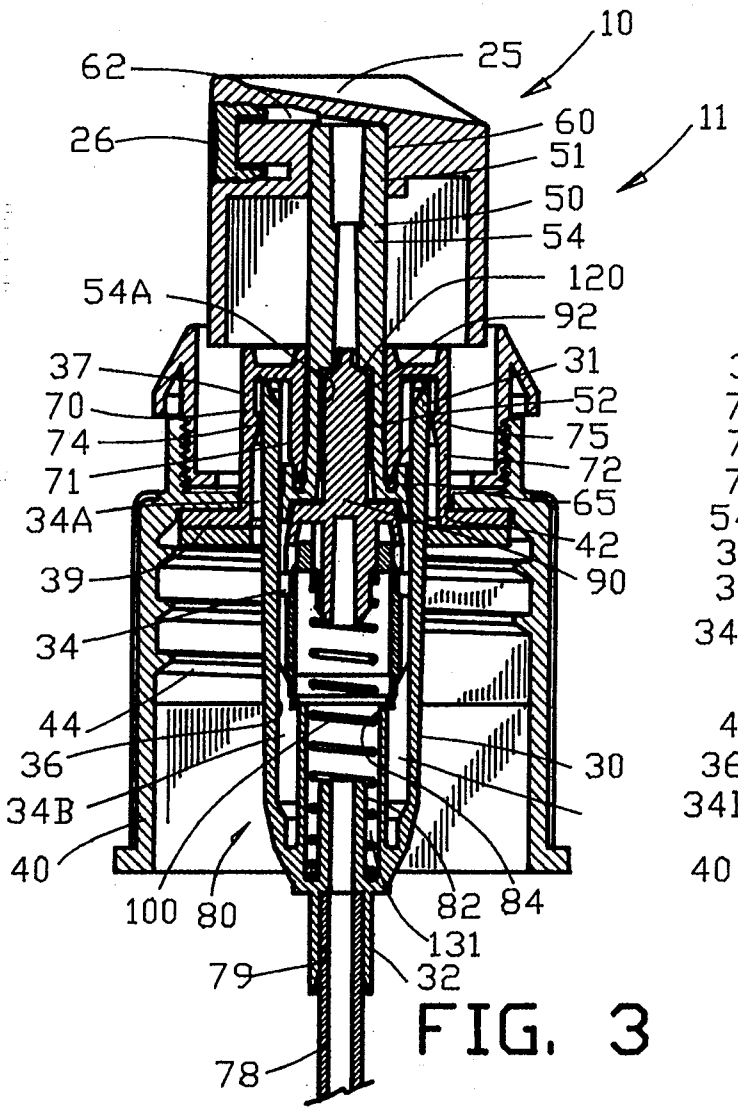
FIG. 3 is a side sectional view of the improved variable restrictor for a manually actuated pump of FIG. 1 with the actuator located in the extended position.

FIGS. 3 and 4 are partial sectional views of the improved variable restrictor 10 for a manually actuated pump 11 in the extended position and the retracted position, respectively. The manually actuated pump 11 comprises a body 30 having a first and a second body end 31 and 32 with an internal pump cylinder 34 disposed therebetween. The internal pump cylinder 34 defines an internal pump cylinder wall 36. The pump 11 includes a stem support 37 secured to the pump body 30 and having a radially outwardly extending flange 39.

A closure 40 defines a central opening 42 for enabling the first body end 31 of the pump body 30 to extend therethrough. The closure 40 is shown having closure threads 44 for securing with container threads (not shown) extending about the container rim 27 of the container 20 in a conventional fashion. When the closure 40 is secured to the container 20, the flange 39 engages with the container rim 27 of the container 20 to seal the pump body 30 to the container 20. Although the closure 40 has been shown attached to the container 20 through closure threads 44, it should be understood that various means may be utilized for securing the closure 40 to the container 20.

The variable restrictor 10 of the present invention may be used with a variety of different pumps of numerous configurations. For the sake of example in the present specification, the manually operated pump 11 is similar to the manually operated pump set forth in U.S. Pat. No. 4,986,453 but it should be understood that the present invention is suitable for use other similar pumps.

A pump stem 50 has a first stem end 51 extending external from the pump body 30 and a second stem end 52 extending internal the pump body 30 with an internal stem passage 54 extending through the pump stem 50. The first stem end 51 supports the actuator 25 with the terminal orifice 26 communicating with the internal stem passage 54 extending through the pump stem 50. The first stem end 51 is received within an actuator aperture 60 communicating with the terminal orifice 26 of the actuator 25. Preferably, the first stem end 51 is frictionally secured within the actuator aperture 60 for enabling fluid communication from the first stem end 51 to the terminal orifice 26 through an actuator channel 62.

The second stem end 52 of the pump stem 50 is slidably disposed within the internal pump cylinder 34 of the body 30 and includes an annular seal 65 for frictionally engaging with the internal pump cylinder wall 36 to form a slidable seal between pump stem 50 and the internal pump cylinder wall 36 of the internal pump cylinder 34. The annular seal 65 divides the internal pump cylinder 34 into a first internal pump cylinder 34A and a second internal pump cylinder 34B.

Although the pump 11 has been shown as a vertical action pump 11 with a finger actuator 25, is should be understood that the present invention may be incorporated into a trigger pump of various configurations or other types of manually operated pumps.

The stem support 37 includes a sleeve 70 having an internal sleeve 71 disposed within the internal pump cylinder 34 of the body 30 and an external sleeve 72 disposed external the body 30. The stem support 37 is provided with stem support clasps 74 for engaging with body clasps 75 defined in the pump body 30 for securing the stem support 37 to the pump body 30. Preferably, the sleeve 70 including the internal sleeve 71 and the external sleeve 72 are unitary with the stem support 37. The sleeve 71 provides a slidable support for the pump stem 50 and limits the extended position of the pump stem 50 and the actuator 25 upon the annular seal 65 engaging the internal sleeve 71.

An induction tube 78 is frictionally secured into an induction tube aperture 79 integrally molded into the second body end 32 of the pump body 30. The induction tube 78 provides fluid communication between the liquid 12 within the container 20 and the internal pump cylinder 34 of the pump body 30.

A first one-way valve means 80 is located proximate the second body end 32 of the pump body 30 for enabling the flow of the liquid 12 only from the container 20 into the internal pump cylinder 34 of the pump body 30. The first one-way valve 80 comprises a valve seat 82 shown as a cylindrical valve seat integrally molded with the pump body 30. The first one-way valve means 80 includes a movable valve member 84 for sealing with the valve seat 82.

The moveable valve member 84 engages a poppet 90 interposed between the second end 51 of the pump stem 50 and the movable valve member 84. The poppet 90 has an extending portion 92 disposed within an enlarged region 54A of the internal stem passage 54 of the pump stem 50.

A spring 100 biases the valve member 84 into engagement with the poppet 90 and biases the popper 90 into engagement with the pump stem 50. A second one-way valve means 120 comprises the extending portion 92 of the poppet 90 being biased into engagement with the enlarged region 54A of the internal stem passage 54 of the pump stem 50.

As the actuator 25 is depressed by the operator, the movable valve member 84 seals with the valve seat 82 to close the first one-way valve means 80 and to form an inner chamber 131. Continued depression of the actuator 25 by the operator reduces the volume of the inner chamber 131.

When the actuator 25 is released by the operator, the inner chamber 131 is expanded to withdraw the liquid 12 from the container 20 into the inner chamber 131. The liquid 12 within the inner chamber 131 flows into an outer chamber 132 between the movable valve member 84 and the valve seat 82 upon the opening of the first one-way valve means 80. The liquid 12 within the inner chamber 131 also flows into the outer chamber 132 between the poppet 90 and the movable valve member 84 upon separation thereof during the released of the actuator 25 by the operator.

Upon a subsequent depression of the actuator 25 by the operator, the movable valve member 84 seals with the valve seat 82 to close the first one-way valve means 80 and to reform the inner chamber 131. The subsequent depression of the actuator 25 by the operator also reduces the volume of the outer chamber 132. The reduced volume of the outer chamber 132 increases the pressure therein to separate the extending portion 92 of the poppet 90 from the enlarged region 54A of the internal stem passage 54 of the pump stem 50 to open the second one-way valve means 120. The opening of the second one-way valve means 120 enables the liquid 12 within the outer chamber 132 to pass through the internal stem passage 54 of the pump stem 50 for discharge from the terminal orifice 26. A full description of the construction and operation of the pump 11 shown herein may be found in U.S. Pat. No. 4,986,453 which is hereby incorporated by reference into the present specification.

Figure 7:
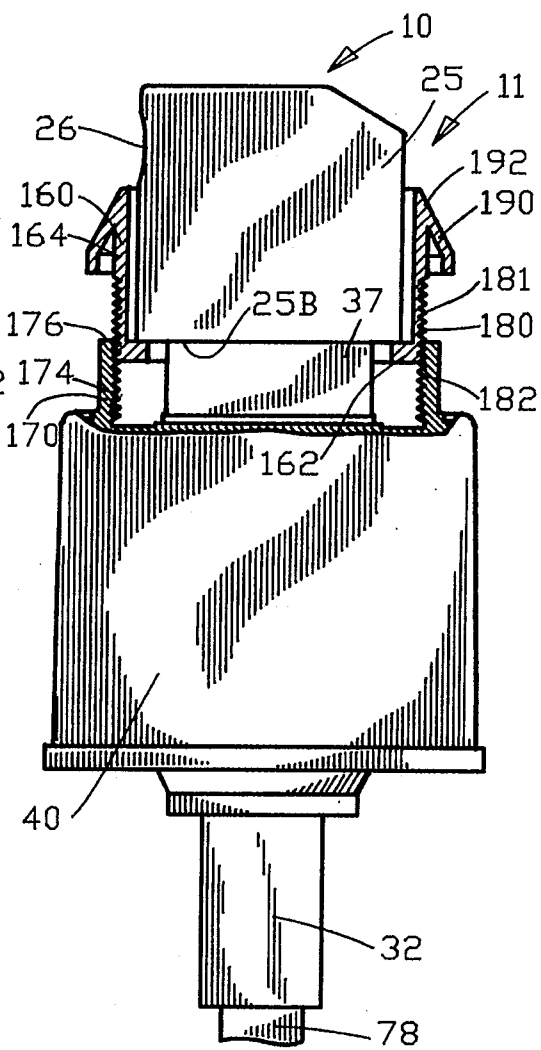
FIG. 7 is an enlarge partial view partially in section of the improved variable restrictor for a manually actuated pump with the actuator located in a second retracted position.
Figure 6:
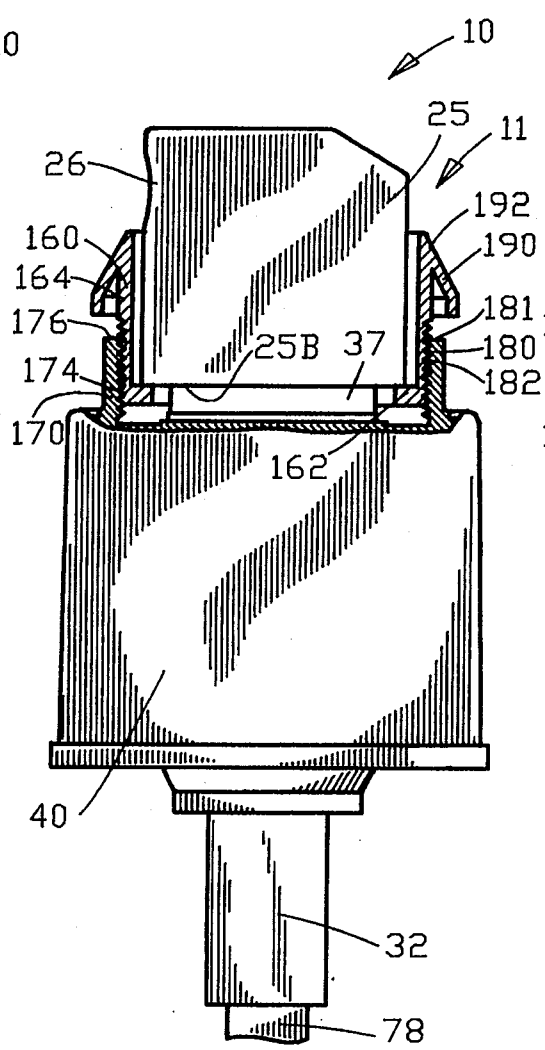
FIG. 6 is an enlarge partial view partially in section of the improved variable restrictor for a manually actuated pump of FIG. 2 with the actuator located in the first retracted position.
Figure 5:
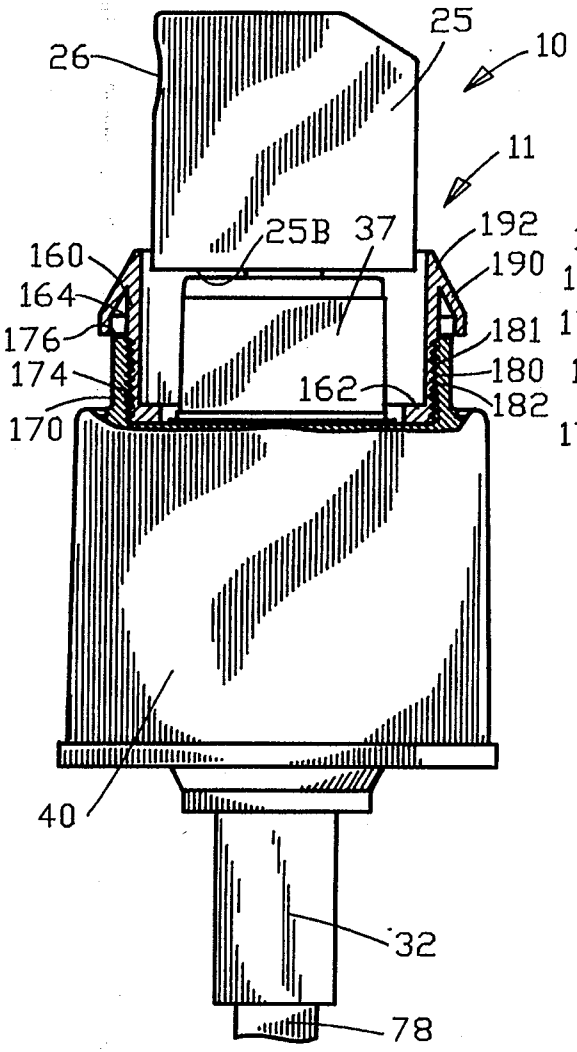
FIG. 5 is an enlarge partial view partially in section of the improved variable restrictor for a manually actuated pump of FIG. 1 with the actuator located in the extended position.

FIGS. 5–7 illustrate the variable restrictor 10 for varying the retracted position to vary the longitudinal movement of the actuator 25 from the extended position shown in FIGS. 1 and 3 to the retracted position as shown in FIGS. 2 and 4. The variation in the longitudinal movement of the actuator 25 alters the volume of liquid discharged from the container 20 through the terminal orifice 26. The variable restrictor 10 comprises an inner collar 160 extending relative to the pump body 30 having an overhang 162 with the inner collar 160 being rotatable about an axis extending through the pump stem 50. Rotation of the inner collar 160 about the pump stem 50 varies the position of the overhang 162 for varying the longitudinal movement of the actuator 25 from the extended position shown in FIG. 1 to the retracted position as shown in FIG. 2. The variation of the longitudinal movement of the actuator 25 varies the volume of liquid discharged from the container 20 through the terminal orifice 26 upon longitudinal movement of the actuator 25 from the extended position to the retracted position.

The variable restrictor comprising the actuator 25 defining a base surface 25B and the inner collar 160 and an outer collar 170 with the outer collar 170 being secured relative to the flange 39. Preferably, the outer collar 170 is integrally formed with the closure 40 with the inner collar 160 being disposed coaxially within the outer collar 170. The inner collar 160 has an overhang 162 extending radially inwardly toward the pump stem 50 for defining the retracted position upon the base surface 25B of the actuator 25 engaging the overhang 162. Thread means 180 are interposed between the inner collar 160 and the outer collar 170 for enabling rotation of the inner collar 160 within the outer collar 170 for varying the position of the overhang 162 to define the retracted position.

FIG. 5 is an enlarge partial view partially in section of the improved variable restrictor 10 for a manually actuated pump of FIG. 1 with the actuator located in the extended position. The inner collar 160 is rotated within the outer collar 170 to position the overhang 162 in an extreme retracted position for enabling a maximum longitudinal movement of the actuator 25 from the extended position shown in FIGS. 1 and 3 to the retracted position as shown in FIGS. 2 and 4. The maximum longitudinal movement of the actuator 25 provides a maximum volume of liquid discharged from the container 20 through the terminal orifice 26.

FIG. 6 is an enlarge partial view partially in section of the improved variable restrictor 10 for a manually actuated pump of FIG. 2 with the actuator 25 located in a first retracted position. The inner collar 160 is rotated within the outer collar 170 to position the overhang 162 in an intermediate retracted position for enabling an intermediate longitudinal movement of the actuator 25 from the extended position to the retracted position as defined by the overhang 162. The intermediate longitudinal movement of the actuator 25 provides an intermediate volume of liquid discharged from the container 20 through the terminal orifice 26.

FIG. 7 is an enlarge partial view partially in section of the improved variable restrictor 10 for a manually actuated pump with the actuator located in a second retracted position. The inner collar 160 is rotated within the outer collar 170 to position the overhang 162 in a minimum retracted position for enabling a minimum longitudinal movement of the actuator 25 from the extended position to the retracted position as defined by the overhang 162. The minimum longitudinal movement of the actuator 25 provides a minimum volume of liquid discharged from the container 20 through the terminal orifice 26.

In the embodiments shown in FIGS. 5–7, the thread means 180 have been shown as continuous threads 181 and 182. The thread means 180 may be established such that the overhang 162 prevents any depression of the actuator 21 when the control collar 190 is rotated into the minimum retracted position shown in FIG. 7. When the thread means 180 is established in this manner, the variable restrictor 10 functions as a lock to prevent depression of the actuator 25.

Figure 8:
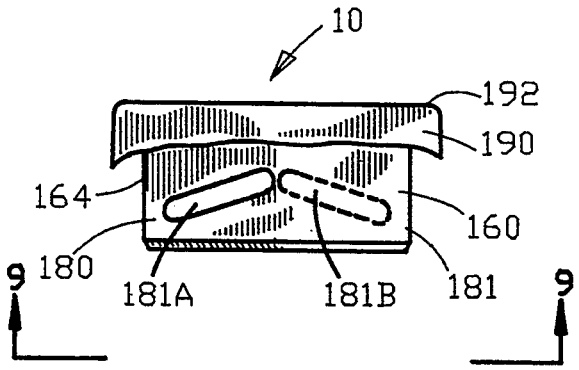
FIG. 8 is an enlarge partially cut away view of the inner collar of the improved variable restrictor for a manually actuated pump.
Figure 9:
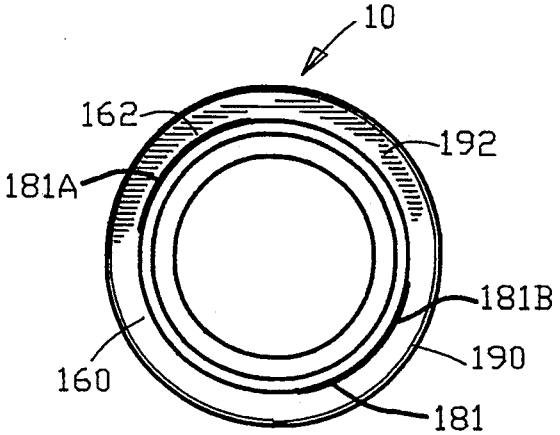
FIG. 9 is a view along line 9—9 in FIG. 8.

FIG. 8 is an enlarged partially cut away view of the inner collar 160 of the improved variable restrictor 10 for a manually actuated pump 11 with FIG. 9 being a view along line 9—9 in FIG. 8. The thread means 180 comprises a helical thread projection 181 extending from an outside surface 164 from the inner collar 160. In this embodiment, the helical thread projection 181 is shown as a first and a second helical thread projection 181A and 181B.

Figure 10:
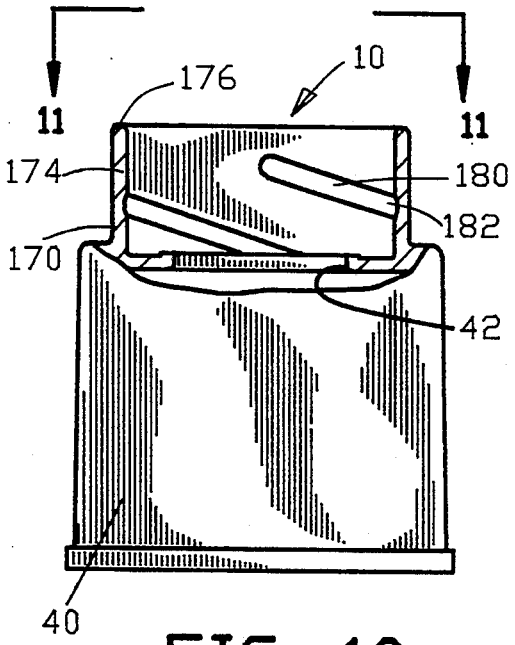
FIG. 10 an enlarge view partially in section of the outer collar of the improved variable restrictor for a manually actuated pump.
Figure 11:
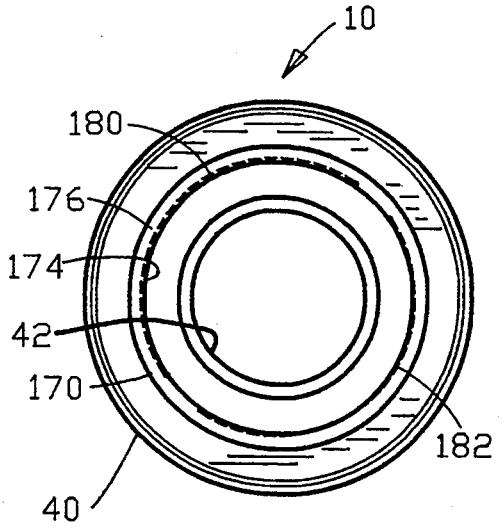
FIG. 11 is a view along line 11—11 in FIG. 10.

FIG. 10 is an enlarge view partially in section of the outer collar 170 of the improved variable restrictor 10 for a manually actuated pump 11 with FIG. 11 being a view along line 11—11 in FIG. 10. The thread means 180 comprises a helical thread recess 182 defined in an inside surface 174 from the outer collar 170. In this embodiment, the helical thread recess 182 is shown as a first and a second helical thread recess 182A and 182B for receiving the first and second helical thread projections 181A and 182B of the inner collar 160. Preferably, the inner and outer collars 160 and 170 are fabricated from a resilient plastic material enabling the first and second helical thread projections 181A and 181B to be snapped into the first and second helical thread recesses 182A and 182B. The pitch of the helical thread means 180 is shown as a high pitch for adjusting the position of the overhang 162 with minimum rotation of the inner collar 160.

Figure 12:
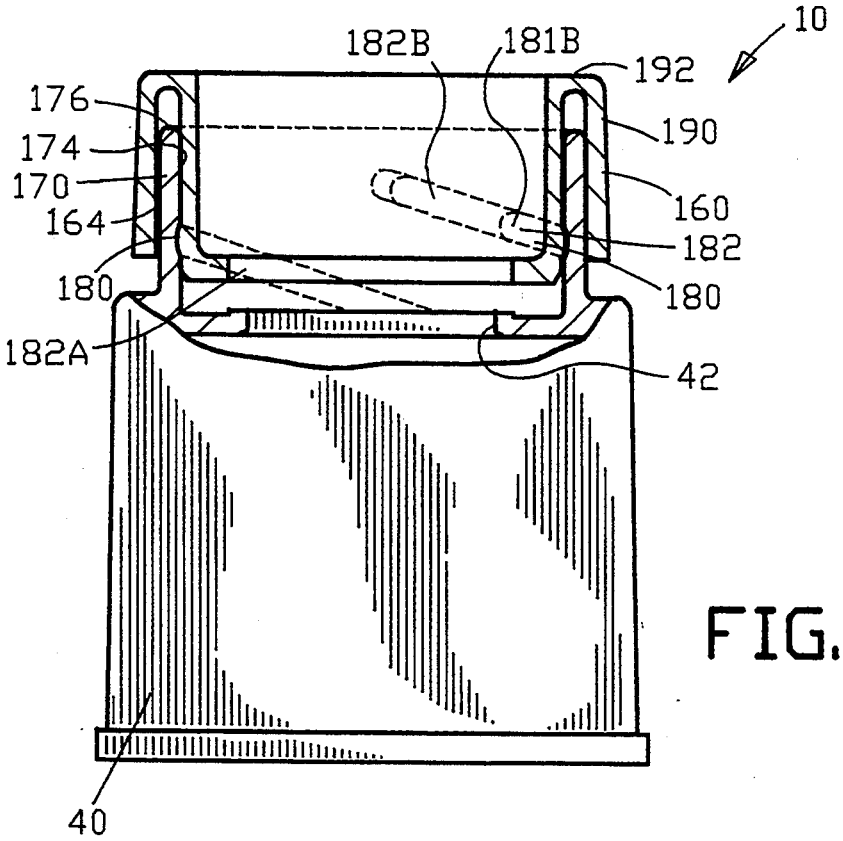
FIG. 12 is an enlarge partially cut away view of the inner and outer collars of the improved variable restrictor for a manually actuated pump with the inner collar disposed in a maximum retracted position.

FIG. 12 is an enlarge partially cut away view of the inner and outer collars 160 and 170 of the improved variable restrictor 10 for a manually actuated pump 11 with the inner collar 160 disposed in a maximum retracted position.

Figure 13:
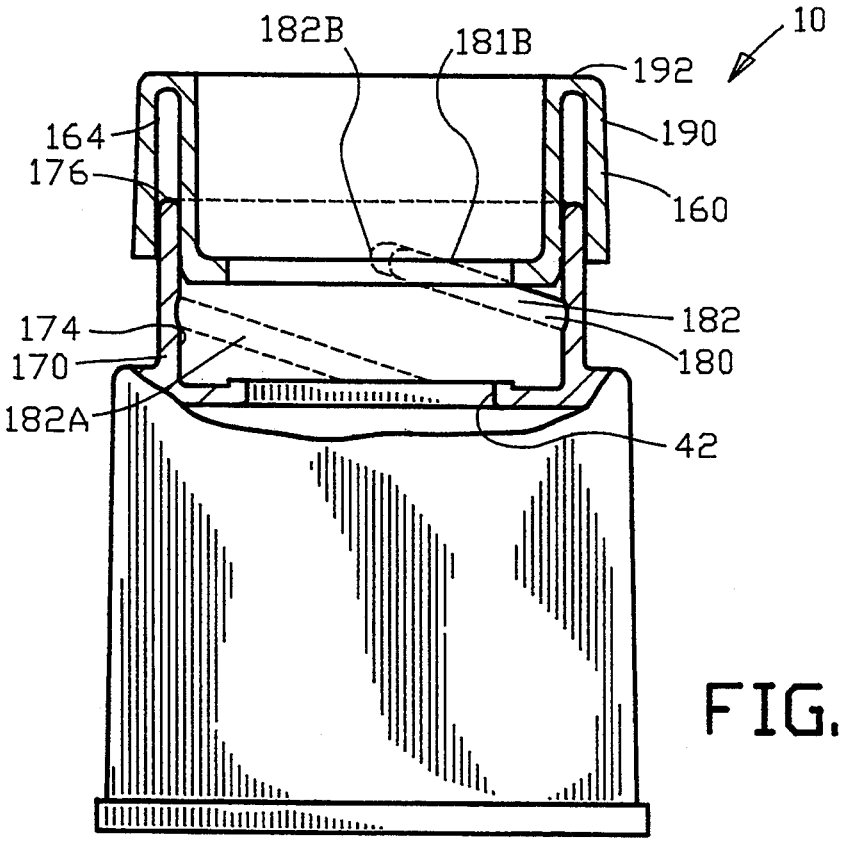
FIG. 13 is an enlarge partially cut away view of the inner and outer collars of the improved variable restrictor for a manually actuated pump with the inner collar disposed in a minimum retracted position.

FIG. 13 is an enlarge partially cut away view of the inner and outer collars 160 and 170 of the improved variable restrictor 10 for a manually actuated pump 11 with the inner collar 160 disposed in a minimum retracted position. The rotation of the inner collar 160 within the outer collar 170 varies the position of the overhang 162 for varying the retracted position to modify the longitudinal distance from the extended position to the retracted position to adjust the volume of liquid discharged from the container 20 through the terminal orifice 26 upon movement of the actuator 25 from the extended position to the retracted position.

A control collar 190 is secured to the inner collar 160 for extending outside of and parallel to the outer collar 170. Preferably, the collar 190 is integrally attached to the inner collar 160 through a bridge 192. The control collar 190 provides means for rotating the inner collar 160 by an operator for varying the volume of liquid discharged from the container 20 through the terminal orifice 26 upon movement of the actuator 25 from the extended position to the retracted position. In addition, the control collar stops the extreme rotation of the inner collar 160 upon the bridge 192 engaging a terminal rim 176 of the outer collar 170.

The present invention provides an improved variable restrictor 10 for a manually actuated pump 11 for dispensing a variable volume of liquid 12 from a container 20 comprising variable restrictor 10 for varying the retracted position of the pump 11 to vary the longitudinal movement of the actuator 25 from the extended position to the retracted position. The variable restrictor alters the volume of liquid 12 discharged from the container 25 through the terminal orifice 26.

The improved variable restrictor 10 for a manually actuated pump 11 provides an option to the operator of the pump 11 for applying a controlled volume of liquid 12 from the container 20 for each depression of the actuator 25. A rotation of the control collar 190 enables a continuous adjustment of the volume of liquid 12 discharged for each depression of the actuator 25 between a maximum volume and a minimum volume. Once the control collar 190 is adjusted by the operator for discharging the desired volume of liquid 12 discharged for each depression of the actuator 25, the improved variable restrictor 10 for a manually actuated pump 11 will provide consistent and repeatable discharges of volume of the liquid 12 for each subsequent depression of the actuator 25. The actuator 25 of the pump 11 remains aligned during actuation by a operator and the control collar 190 may be varied with a minimal adjustment by the operator.

The adjustment of the volume of liquid 12 discharged for each depression of the actuator 25 eliminates the need for a operator to subjectively stop the depression of the actuator 25 during the depression of the actuator 25 from the extended position to the retracted position. Furthermore, the improved variable restrictor 10 for a manually actuated pump 11 enables a manufacturer to preset a maximum or minimum volume of discharge per depression of the actuator 25 or a selected volume of discharge per depression of the actuator 25.

The improved variable restrictor 10 for a manually actuated pump 11 of the present invention is simple to operate by the operator and is easy to vary the volume of liquid discharged from the pump. The improved variable restrictor 10 for a manually actuated pump 11 does not appreciably increase material cost of the pump and is easy to manufacture.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved variable restrictor for a manually actuated pump for dispensing a variable volume of liquid from a container, comprising in combination:

a body having a first body end and a second body end with an internal pump cylinder interposed therebetween;

securing means for securing said body to the container;

an induction tube affixed to said second body end of said body for providing fluid communication between the liquid within the container and said internal pump cylinder of said body;

first one-way valve means for enabling the flow of the liquid only from the container into said internal pump cylinder of said body;

a piston slidably disposed within said internal pump cylinder of said body;

a pump stem having a first and a second stem end with an internal stem passage extending therein;

said first stem end being disposed external said body with said second stem end being disposed within said internal pump cylinder body;

a spring for biasing said pump stem and said piston into an extended position;

second one-way valve means cooperating with said piston for enabling the flow of the liquid only from said internal pump cylinder into said second end of said internal stem passage of said pump stem;

an actuator having a base surface and including a terminal orifice communicating with said first end of said internal stem passage of said pump stem;

said actuator discharging a volume of the liquid from the container through said terminal orifice upon a longitudinal movement of said actuator from an extended position to a retracted position by an operator;

variable restrictor means for varying said retracted position to vary said longitudinal movement of said actuator from said extended position to said retracted position for altering the volume of liquid discharged from the container through said terminal orifice;

said variable restrictor means providing a continuous variation of said retracted position independent of a rotational position of said actuator;

said variable restrictor means comprising a collar being spaced apart from said piston stem for enabling said actuator base surface to be received within said collar;

said collar having an overhang extending radially inwardly toward said pump stem for defining said retracted position upon engagement of said base surface of said actuator; and;

said collar being rotatable relative to said body for varying the position of said overhang to vary said longitudinal movement of said actuator from said extended position to said retracted position upon rotation of said collar.

2. An improved variable restrictor for a manually actuated pump for dispensing a variable volume of liquid from a container as set forth in claim 1, wherein said container has a container rim defining a container opening;

said securing means comprising a flange extending radially outwardly from said body; and a closure having a central opening for receiving said body therein enabling said closure to be affixed to said container for securing said flange into engagement with said closure rim.

3. An improved variable restrictor for a manually actuated pump for dispensing a variable volume of liquid from a container as set forth in claim 1, wherein said variable restrictor means comprises an inner collar having an overhang extending radially inwardly toward said pump stem for defining said retracted position.

4. An improved variable restrictor for a manually actuated pump for dispensing a variable volume of liquid from a container as set forth in claim 1, wherein said variable restrictor means comprises an inner collar having an overhang extending radially inwardly toward said pump stem; and said overhang defining said retracted position for varying said longitudinal movement of said actuator from said extended position to said retracted position.

5. An improved variable restrictor for a manually actuated pump for dispensing a variable volume of liquid from a container as set forth in claim 1, wherein said actuator includes a base surface;

said variable restrictor means comprising an inner collar having an overhang extending radially inwardly toward said pump stem; and said overhang defining said retracted position upon engagement of said base surface of said actuator with said overhang for varying said longitudinal movement of said actuator from said extended position to said retracted position.

6. An improved variable restrictor for a manually actuated pump for dispensing a variable volume of liquid from a container as set forth in claim 1, wherein said variable restrictor means comprises an inner collar having an overhang extending radially inwardly toward said pump stem;

said overhang defining said retracted position for varying said longitudinal movement of said actuator from said extended position to said retracted position; and said inner collar being rotatable about an axis extending through said body for varying the position of said overhang for varying said longitudinal movement of said actuator from said extended position to said retracted position for varying the volume of liquid discharged from the container through said terminal orifice upon longitudinal movement of said actuator from said extended position to said retracted position.

7. An improved variable restrictor for a manually actuated pump for dispensing a variable volume of liquid from a container as set forth in claim 1, wherein said actuator defines a base surface;

said variable restrictor means comprising an inner collar having an overhang extending radially inwardly toward said pump stem;

said overhang defining said retracted position upon said base surface of said actuator engaging said overhang; and said inner collar being rotatable about an axis extending through said body for modifying the position of said overhang for varying the longitudinal distance from said extended position to said retracted position to alter the volume of liquid discharged from the container through said terminal orifice upon longitudinal movement of said actuator from said extended position to said retracted position.

8. An improved variable restrictor for a manually actuated pump for dispensing a variable volume of liquid from a container, comprising in combination:

a body having a first body end and a second body end with an internal pump cylinder interposed therebetween;

securing means for securing said body to the container;

an induction tube affixed to said second body end of said body for providing fluid communication between the liquid within the container and said internal pump cylinder of said body;

first one-way valve means for enabling the flow of the liquid only from the container into said internal pump cylinder of said body;

a piston slidably disposed within said internal pump cylinder of said body;

a pump stem having a first and a second stem end with an internal stem passage extending therein;

said first stem end being disposed external said body with said second stem end being disposed within said internal pump cylinder of said body;

a spring for biasing said pump stem and said piston into an extended position;

second one-way valve means comprising said second stem end cooperating with said piston for enabling the flow of the liquid only from said internal pump cylinder into said internal stem passage of said pump stem;

an actuator having a terminal orifice communicating with said internal stem passage of said pump stem;

said actuator discharging a volume of the liquid from the container through said terminal orifice upon a longitudinal movement of said actuator from an extended position to a retracted position by an operator;

variable restrictor means for varying said retracted position to vary said longitudinal movement of said actuator from said extended position to said retracted position for altering the volume of liquid discharged from the container through said terminal orifice;

said actuator defining a base surface;

said variable restrictor means comprising an inner collar and an outer collar with said inner collar disposed coaxially within said outer collar;

said outer collar being secure relative to said closure;

said inner collar having an overhang extending radially inwardly toward said pump stem for defining said retracted position upon said base surface of said actuator engaging said overhang;

thread means interposed between said inner collar and said outer collar for enabling rotation of said inner collar within said outer collar; and said rotation of said inner collar within said outer collar varying the position of said overhang for varying said retracted position for varying the longitudinal distance from said extended position to said retracted position to vary the volume of liquid discharged from the container through said terminal orifice upon movement of said actuator from said extended position to said retracted position.

9. An improved variable restrictor for a manually actuated pump for dispensing a variable volume of liquid from a container, comprising in combination:

a body having a first body end and a second body end with an internal pump cylinder interposed therebetween;

securing means for securing said body to the container;

an induction tube affixed to said second body end of said body for providing fluid communication between the liquid within the container and said internal pump cylinder of said body;

first one-way valve means for enabling the flow of the liquid only from the container into said internal pump cylinder of said body;

a piston slidably disposed within said internal pump cylinder of said body;

an internal passage having a first and second end with said first end being disposed external said body with said second end being disposed within said internal pump cylinder of said body;

a spring for biasing said piston into an extended position;

second one-way valve means cooperating with said piston for enabling the flow of the liquid only from said internal pump cylinder into said second end of said internal passage;

an actuator having a terminal orifice communicating with said first end of said internal passage;

said actuator discharging a volume of the liquid from the container through said terminal orifice upon a longitudinal movement of said actuator from an extended position to a retracted position by an operator;

variable restrictor means for varying said retracted position to vary said longitudinal movement of said actuator from said extended position to said retracted position for altering the volume of liquid discharged from the container through said terminal orifice;

said variable restrictor means providing a continuous variation of said retracted position independent of a rotational position of said actuator;

said container having a container rim defining a container opening;

said securing means comprising a flange extending radially outwardly from said body for enabling a closure to secure said flange into engagement with said closure rim;

said actuator defining a base surface;

said variable restrictor means comprising an inner collar and an outer collar with said outer collar being secured relative to said flange;

said inner collar being disposed coaxially within said outer collar and having an overhang extending radially inwardly toward said pump stem for defining said retracted position upon said base surface of said actuator engaging said overhang;

thread means interposed between said inner collar and said outer collar for enabling rotation of said inner collar within said outer collar; and said rotation of said inner collar within said outer collar varying the position of said overhang for varying said retracted position for varying the longitudinal distance from said extended position to said retracted position to vary the volume of liquid discharged from the container through said terminal orifice upon movement of said actuator from said extended position to said retracted position.

10. An improved variable restrictor for a manually actuated pump for dispensing a variable volume of liquid from a container, comprising in combination:

a body having a first body end and a second body end with an internal pump cylinder interposed therebetween;

securing means for securing said body to the container;

an induction tube affixed to said second body end of said body for providing fluid communication between the liquid within the container and said internal pump cylinder of said body;

first one-way valve means for enabling the flow of the liquid only from the container into said internal pump cylinder of said body;

a piston slidably disposed within said internal pump cylinder of said body;

an internal passage having a first and second end with said first end being disposed external said body with said second end being disposed within said internal pump cylinder of said body;

a spring for biasing said piston into an extended position;

second one-way valve means cooperating with said piston for enabling the flow of the liquid only from said internal pump cylinder into said second end of said internal passage;

an actuator having a terminal orifice communicating with said first end of said internal passage;

said actuator discharging a volume of the liquid from the container through said terminal orifice upon a longitudinal movement of said actuator from an extended position to a retracted position by an operator;

variable restrictor means for varying said retracted position to vary said longitudinal movement of said actuator from said extended position to said retracted position for altering the volume of liquid discharged from the container through said terminal orifice;

said variable restrictor means providing a continuous variation of said retracted position independent of a rotational position of said actuator;

said container having a container rim defining a container opening;

said securing means comprising a flange extending radially outwardly from said body for enabling a closure to secure said flange into engagement with said closure rim;

said actuator defining a base surface;

said variable restrictor means comprising an inner collar and an outer collar with said outer collar being secured relative to said flange;

said inner collar being disposed coaxially within said outer collar and having an overhang extending radially inwardly for defining said retracted position upon said base surface of said actuator engaging said overhang;

thread means interposed between said inner collar and said outer collar for enabling rotation of said inner collar within said outer collar;

said thread means comprising a helical thread recess defined in one of said collars for receiving a helical thread projection extending from the other of said collars; and said rotation of said inner collar within said outer collar varying the position of said overhang for varying said retracted position for varying the longitudinal distance from said extended position to said retracted position to vary the volume of liquid discharged from the container through said terminal orifice upon movement of said actuator from said extended position to said retracted position.

11. An improved variable restrictor for a manually actuated pump for dispensing a variable volume of liquid from a container, comprising in combination:

a body having a first body end and a second body end with an internal pump cylinder interposed therebetween;

securing means for securing said body to the container;

an induction tube affixed to said second body end of said body for providing fluid communication between the liquid within the container and said internal pump cylinder of said body;

first one-way valve means for enabling the flow of the liquid only from the container into said internal pump cylinder of said body;

a piston slidably disposed within said internal pump cylinder of said body;

an internal passage having a first and second end with said first end being disposed external said body with said second end being disposed within said internal pump cylinder of said body;

a spring for biasing said piston into an extended position;

second one-way valve means cooperating with said piston for enabling the flow of the liquid only from said internal pump cylinder into said second end of said internal passage;

an actuator having a terminal orifice communicating with said first end of said internal passage;

said actuator discharging a volume of the liquid from the container through said terminal orifice upon a longitudinal movement of said actuator from an extended position to a retracted position by an operator;

variable restrictor means for varying said retracted position to vary said longitudinal movement of said actuator from said extended position to said retracted position for altering the volume of liquid discharged from the container through said terminal orifice;

said variable restrictor means providing a continuous variation of said retracted position independent of a rotational position of said actuator;

said container having a container rim defining a container opening;

said securing means comprising a flange extending radially outwardly from said body for enabling a closure to secure said flange into engagement with said closure rim;

said actuator defining a base surface;

said variable restrictor means comprising an inner collar and an outer collar with said outer collar being secured relative to said flange;

said inner collar being disposed coaxially within said outer collar and having an overhang extending radially inwardly for defining said retracted position upon said base surface of said actuator engaging said overhang;

thread means comprising a helical thread recess cooperating with a helical thread projection interposed between one of said inner collar and said outer collar for enabling rotation of said inner collar within said outer collar;

said rotation of said inner collar within said outer collar varying the position of said overhang for varying said retracted position for varying the longitudinal distance from said extended position to said retracted position to vary the volume of liquid discharged from the container through said terminal orifice upon movement of said actuator from said extended position to said retracted position;

a control collar secured to said inner collar for stopping extreme inward rotation of said inner collar; and said control collar providing means for rotating the inner collar by an operator for varying the volume of liquid discharged from the container through said terminal orifice upon movement of said actuator from said extended position to said retracted position.

12. In a manually actuated pump for dispensing a product disposed within a container, the pump comprising a pump body having an internal pump cylinder with a piston including an actuator stem slidably disposed within the internal pump cylinder, the actuator stem having an internal stem passage terminating in a terminal orifice disposed external the pump body, a first one-way valve means for enabling the flow of the product from a container into the internal pump cylinder and a second one-way valve means for enabling the flow of the product from the internal pump cylinder into the internal stem passage, with a spring biasing the piston into an extended position for enabling the actuator stem to be longitudinally moved between the extended position and a retracted position for pumping the product from the container for discharge from the terminal orifice:

the improvement comprising:

variable restrictor means for varying the retracted position to limit the longitudinal movement of the actuator stem from the extended position to the retracted position for altering the volume of liquid discharged from the container through the terminal orifice; and said variable restrictor means providing a continuous variation of the retracted position independent of a rotational position of the stem actuator stem;

said variable restrictor means comprising an inner collar and an outer collar;

said outer collar being secure relative to said closure;

said inner collar being disposed coaxially within said outer collar and having an overhang extending radially inwardly for defining the retracted position upon a base surface of the actuator stem engaging said overhang;

thread means interposed between said inner collar and said outer collar for enabling rotation of said inner collar within said outer collar;

said thread means comprising a helical thread recess defined in one of said collars for receiving a helical thread projection extending from the other of said collars; and said rotation of said inner collar within said outer collar varying the position of said overhang for varying the retracted position to limit the longitudinal distance from the extended position to the retracted position to vary the volume of liquid discharged from the container through the terminal orifice upon movement of the actuator stem from the extended position to the retracted position.

13. In a manually actuated pump for dispensing a product disposed within a container, the pump comprising a pump body having an internal pump cylinder with a piston including an actuator stem slidably disposed within the internal pump cylinder, the actuator stem having an internal stem passage terminating in a terminal orifice disposed external the pump body, a first one-way valve means for enabling the flow of the product from a container into the internal pump cylinder and a second one-way valve means for enabling the flow of the product from the internal pump cylinder into the internal stem passage, with a spring biasing the piston into an extended position for enabling the actuator stem to be longitudinally moved between the extended position and a retracted position for pumping the product from the container for discharge from the terminal orifice:

the improvement comprising:

variable restrictor means including thread means for varying the retracted position upon rotation of said variable restrictor means to limit the longitudinal movement of the actuator stem from the extended position to the retracted position for continuously altering the volume of liquid discharged from the container through the terminal orifice;

said variable restrictor means comprising an inner collar and an outer collar with said inner collar disposed coaxially within said outer collar;

said outer collar being secure relative to said closure;

said thread means comprising a helical thread recess defined in one of said collars for receiving a helical thread projection extending from the other of said collars; and said rotation of said inner collar within said outer collar varying the retracted position for varying the longitudinal distance from the extended position to the retracted position to vary the volume of liquid discharged from the container through the terminal orifice upon movement of the actuator stem from the extended position to the retracted position.

14. In a manually actuated pump for dispensing a product disposed within a container, the pump comprising a pump body having an internal pump cylinder with a piston including an actuator stem slidably disposed within the internal pump cylinder, the actuator stem having an internal stem passage terminating in a terminal orifice disposed external the pump body, a first one-way valve means for enabling the flow of the product from a container into the internal pump cylinder and a second one-way valve means for enabling the flow of the product from the internal pump cylinder into the internal stem passage, with a spring biasing the piston into an extended position for enabling the actuator stem to be longitudinally moved between the extended position and a retracted position for pumping the product from the container for discharge from the terminal orifice:

the improvement comprising:

variable restrictor means including thread means for varying the retracted position upon rotation of said variable restrictor means to limit the longitudinal movement of the actuator stem from the extended position to the retracted position for continuously altering the volume of liquid discharged from the container through the terminal orifice;

said variable restrictor means comprising an inner collar and an outer collar with said inner collar disposed coaxially within said outer collar;

said outer collar being secure relative to said closure;

said inner collar having an overhang extending radially inwardly for defining the retracted position upon a base surface of the actuator stem engaging said overhang;

said thread means being interposed between said inner collar and said outer collar for enabling rotation of said inner collar within said outer collar; and said rotation of said inner collar within said outer collar varying the position of said overhang for varying the retracted position for varying the longitudinal distance from the extended position to the retracted position to vary the volume of liquid discharged from the container through the terminal orifice upon movement of the actuator stem from the extended position to the retracted position.

15. An improved variable restrictor for a manually actuated pump for dispensing a variable volume of liquid from a container, comprising in combination:

a body having a first body end and a second body end with an internal pump cylinder interposed therebetween;

securing means for securing said body to the container;

an induction tube affixed to said second body end of said body for providing fluid communication between the liquid within the container and said internal pump cylinder of said body;

first one-way valve means for enabling the flow of the liquid only from the container into said internal pump cylinder of said body;

a piston slidably disposed within said internal pump cylinder of said body;

an internal passage having a first and second end with said first end being disposed external said body with said second end being disposed within said internal pump cylinder of said body;

a spring for biasing said piston into an extended position;

second one-way valve means cooperating with said piston for enabling the flow of the liquid only from said internal pump cylinder into said second end of said internal passage;

an actuator having a terminal orifice communicating with said first end of said internal passage;

said actuator discharging a volume of the liquid from the container through said terminal orifice upon a longitudinal movement of said actuator from an extended position to a retracted position by an operator;

variable restrictor means for varying said retracted position to vary said longitudinal movement of said actuator from said extended position to said retracted position for altering the volume of liquid discharged from the container through said terminal orifice;

said variable restrictor means providing a continuous variation of said retracted position independent of a rotational position of said actuator;

said securing means comprising a flange extending radially outwardly from the pump body for securing said flange to the container;

the actuator stem defining a base surface;

said variable restrictor means comprising an inner collar and an outer collar with said outer collar being secured relative to said flange;

said inner collar being disposed coax;ally within said outer collar and having an overhang extending radially inwardly for defining the retracted position upon said base surface of the actuator stem engaging said overhang;

thread means interposed between said inner collar and said outer collar for enabling rotation of said inner collar within said outer collar; and said rotation of said inner collar within said outer collar varying the position of said overhang for varying the retracted position for varying the longitudinal distance from the extended position to the retracted position to vary the volume of liquid discharged from the container through the terminal orifice upon movement of the actuator stem from the extended position to the retracted position.

16. In a manually actuated pump for dispensing a product disposed within a container, the pump comprising a pump body having an internal pump cylinder with a piston including an actuator stem slidably disposed within the internal pump cylinder, the actuator stem having an internal stem passage terminating in a terminal orifice disposed external the pump body, a first one-way valve means for enabling the flow of the product from a container into the internal pump cylinder and a second one-way valve means for enabling the flow of the product from the internal pump cylinder into the internal stem passage, with a spring biasing the piston into an extended position for enabling the actuator stem to be longitudinally moved between the extended position and a retracted position for pumping the product from the container for discharge from the terminal orifice:

the improvement comprising:

variable restrictor means including thread means for varying the retracted position upon rotation of said variable restrictor means to limit the longitudinal movement of the actuator stem from the extended position to the retracted position for continuously altering the volume of liquid discharged from the container through the terminal orifice;

the container having a container rim defining a container opening;

said securing means comprising a flange extending radially outwardly from the pump body for enabling a closure to secure said flange into engagement with said closure rim;

the actuator stem defining a base surface;

said variable restrictor means comprising an inner collar and an outer collar with said outer collar being secured relative to said flange;

said inner collar being disposed coaxially within said outer collar and having an overhang extending radially inwardly for defining the retracted position upon said base surface of the actuator stem engaging said overhang;

thread means comprising a helical thread recess cooperating with a helical thread projection interposed between one of said inner collar and said outer collar for enabling rotation of said inner collar within said outer collar;

said rotation of said inner collar within said outer collar varying the position of said overhang for varying the retracted position for varying the longitudinal distance from the extended position to the retracted position to vary the volume of liquid discharged from the container through the terminal orifice upon movement of the actuator stem from the extended position to the retracted position;

a control collar secured to said inner collar for stopping extreme inward rotation of said inner collar; and said control collar providing means for rotating the inner collar by an operator for varying the volume of liquid discharged from the container through the terminal orifice upon movement of the actuator stem from the extended position to the retracted position.

* * * * *